US012251002B2

(12) United States Patent
Lam

(10) Patent No.: US 12,251,002 B2
(45) Date of Patent: Mar. 18, 2025

(54) TABLET COMPUTER PROTECTIVE COVER

(71) Applicant: Dong Guan Mercury Home Appliance Products LTD., Dong Guan (CN)

(72) Inventor: Siu Mang Lam, Dong Guan (CN)

(73) Assignee: Dong Guan Mercury Home Appliance Products LTD., Dong Guan (CN)

( * ) Notice: Subject to any disclaimer, the term of this patent is extended or adjusted under 35 U.S.C. 154(b) by 0 days.

(21) Appl. No.: 18/363,595

(22) Filed: Aug. 1, 2023

(65) Prior Publication Data

US 2024/0041173 A1 Feb. 8, 2024

(30) Foreign Application Priority Data

Aug. 2, 2022 (CN) ..... 202222016808.1

(51) Int. Cl.

| | |
|---|---|
| ***A45C 11/00*** | (2006.01) |
| ***A45C 13/00*** | (2006.01) |
| ***A45C 13/02*** | (2006.01) |
| ***A45C 13/10*** | (2006.01) |

(52) U.S. Cl.

CPC ..... *A45C 11/00* (2013.01); *A45C 13/005* (2013.01); *A45C 13/02* (2013.01); *A45C 13/1069* (2013.01); *A45C 2011/003* (2013.01); *A45C 2013/025* (2013.01); *A45C 2200/15* (2013.01)

(58) Field of Classification Search

CPC ..... A45C 11/00; A45C 13/005; A45C 13/02; A45C 13/1069; A45C 2011/003; A45C 2013/025; A45C 2200/15; G06F 1/1616; G06F 2200/1633; F16M 11/105; F16M 11/38; F16M 13/00; F16M 13/022

USPC ..... 206/736, 320, 45.2, 45.24

See application file for complete search history.

(56) References Cited

U.S. PATENT DOCUMENTS

| | | | | |
|---|---|---|---|---|
| 8,746,449 | B2 * | 6/2014 | Gallagher | F16M 13/005 206/320 |
| 8,887,902 | B1 * | 11/2014 | Liu | G06F 1/1626 206/320 |
| 9,027,747 | B2 * | 5/2015 | Hsu | G06F 1/1626 206/45.2 |

(Continued)

FOREIGN PATENT DOCUMENTS

| | | |
|---|---|---|
| CN | 203773430 U | 8/2014 |
| CN | 209086812 U | 7/2019 |
| CN | 216627714 U | 5/2022 |

*Primary Examiner* — Rafael A Ortiz

(74) *Attorney, Agent, or Firm* — Hemisphere Law, PLLC; Zhigang Ma

(57) ABSTRACT

A tablet computer protective cover is disclosed according to the present disclosure, which comprises a cover body and a support frame, the cover body is provided with a cavity for installing the tablet computer, the support frame is provided with a bearing plate for bearing the cover body, a back of the cover body is provided with a first assembly component, a second assembly component matched with the first assembly component is arranged on the bearing plate, the first and second assembly components may rotate relative to each other after being combined. The scheme of the present application not only satisfies the split design, allowing the cover body to be used alone, but also allows the support frame and cover body to rotate without disassembly, allowing for convenient adjustment of the direction presented by the cover body, making user operation easier and more convenient.

4 Claims, 6 Drawing Sheets

(56) References Cited

U.S. PATENT DOCUMENTS

| | | | | |
|---|---|---|---|---|
| 2012/0012483 | A1* | 1/2012 | Fan | F16M 13/00 206/320 |
| 2012/0285859 | A1* | 11/2012 | Law | G06F 1/1632 206/736 |
| 2013/0134061 | A1* | 5/2013 | Wu | G06F 1/1626 206/320 |
| 2014/0151248 | A1* | 6/2014 | Hurst | B65D 25/24 206/45.23 |
| 2015/0083615 | A1* | 3/2015 | Lay | H04M 1/04 206/45.24 |
| 2015/0173219 | A1* | 6/2015 | Hale | F16M 11/10 16/225 |
| 2017/0170863 | A1* | 6/2017 | Liu | H04W 52/0254 |

* cited by examiner

TABLET COMPUTER PROTECTIVE COVER

CROSS-REFERENCE TO RELATED APPLICATIONS

The application claims priority to Chinese patent application No. 202222016808.1, filed on Aug. 2, 2022, the entire contents of which are incorporated herein by reference.

TECHNICAL FIELD

The present application relates to the technical field of tablet computer peripheral accessories, and in particular to a tablet computer protective cover.

BACKGROUND

As we all know, a tablet computer protective cover is a cover used for sleeving on the tablet computer, which is mainly used for protecting the tablet computer. In order to avoid holding the tablet computer by hand, a support frame is arranged on the back of some tablet computer protective covers, and the support structure formed by the support frame is used to support the tablet computer.

At present, most of the existing tablet computer protection racks with support frames are integrated with the cover body, and these support frames become cumbersome when they are not needed. Therefore, some tablet computer protective covers are designed as split structures, that is, the support frame and the cover body are designed separately, and they may be combined when they need to be combined, and they may be removed when they are not needed. However, in use, it can be found that, when only the tablet computer needs to be rotated, so that the tablet computer may be placed horizontally or vertically, or the cover body is detached from the support frame first, and then rotated and mounted in alignment. Otherwise, the tablet computer protective cover based on the principle of magnetic attraction installation is forced to rotate by external force and then adsorbed on the tablet computer. Therefore, it can be understood that the first one often makes the operation more cumbersome and not convenient enough; the second type is often more labor-intensive and not labor-saving enough.

SUMMARY

In view of the shortcomings in the conventional technology, an object of the present application is to provide a tablet computer protective cover.

In order to achieve the above object, the following technical scheme is adopted according to the present application:

A tablet computer protective cover, including a cover body and a support frame. The cover body is provided with a cavity for installing the tablet computer, the support frame is provided with a bearing plate for bearing the cover body, a back of the cover body is provided with a first assembly component, a second assembly component matched with the first assembly component is arranged on the bearing plate;

- the first assembly component may be rotatably mounted on the back of the cover body relative to the cover body, and the second assembly component is fixedly mounted on the bearing plate;
- or, the first assembly component is fixedly mounted on the back of the cover body, and the second assembly component is rotatably mounted on the bearing plate;

- or, the first assembly component may be rotatably mounted on the back of the cover body, and the second assembly component may be rotatably mounted on the bearing plate.

Preferably, both the first assembly component and the second assembly component are embedded with magnetic attraction members;

- a magnetic attraction part of the first assembly component is a magnet, and a magnetic attraction part of the second assembly component is an iron sheet;
- or, the magnetic attraction part of the first assembly component is an iron sheet, and the magnetic attraction part of the second assembly component is a magnet;
- or, the magnetic attraction parts of the first assembly component and the second assembly component are both magnets.

Preferably, when the first and second assembly components are mounted in a rotating manner, the side surfaces of the first and second assembly components are provided with annular clamping grooves, mounting holes are defined on the opposite cover body and the bearing plate, the first and second assembly components are mounted in alignment in the mounting hole, and the annular clamping groove is docked with a side opening of the mounting hole. In addition, a movable gap is reserved between the annular clamping groove and the side opening of the mounting hole, so that the first assembly component and the second assembly component may rotate.

Preferably, the support frame is further provided with a bottom plate and a connecting plate, one end of the connecting plate is connected with the bottom plate through a bending part, and the other end of the connecting plate is connected with the bearing plate through the bending part.

Preferably, at least one limiting groove is defined on the bottom plate.

With the adoption of the scheme, the present application mainly has the following beneficial effects:

- the protective cover adopts the split design of the cover body and the support frame as a whole, so that the support frame may be detached manually, and may be removed when the support frame is not needed, so that the support frame is prevented from becoming cumbersome, and the application is more flexible and diverse;
- the rotatable design of the first assembly component and the second assembly component not only meets the requirements of split assembly, but also enables the support frame and the cover body to rotate without disassembly, meeting the requirement of conveniently adjusting the direction presented by the cover body, and making the operation easier and more convenient for users.

DETAILED DESCRIPTION OF THE EMBODIMENTS

In order to make the purpose, technical scheme and advantages of the present application more clear, the present application is further described in detail with the attached drawings and examples. It should be understood that the specific embodiments described here are only for explaining the present application, and are not used to limit the present application.

In the description of the present application, it should be understood that the terms center, longitudinal direction, transverse direction, length, width, thickness, top, bottom, front, back, left, right, vertical and horizontal. It is only for the convenience of describing the present application and simplifying the description, and does not indicate or imply that the referred devices or elements must have a specific orientation, be constructed and operated in a specific orientation, so it cannot be understood as limiting the present application. In addition, the terms "first" and "second" are only used for descriptive purposes, and cannot be understood as indicating or implying relative importance or implicitly indicating the number of indicated technical features. Thus, the features defined as "first" and "second" may explicitly or implicitly include one or more of said features. In the description of the present application, "multiple" means two or more, unless otherwise specifically defined.

In the description of the present application, it should be noted that unless otherwise specified and limited, the terms "installation", "connection" and "connection" should be broadly understood. For example, it can be a fixed connection, a detachable connection or an integral connection. It can be a mechanical connection or an electrical connection. It can be directly connected or indirectly connected through an intermediate medium, which can be the internal connection between two components or the interaction relationship between two components. For ordinary technical personnel in this field, the specific meanings of the above terms in the present application can be understood based on specific circumstances.

Figure 1:
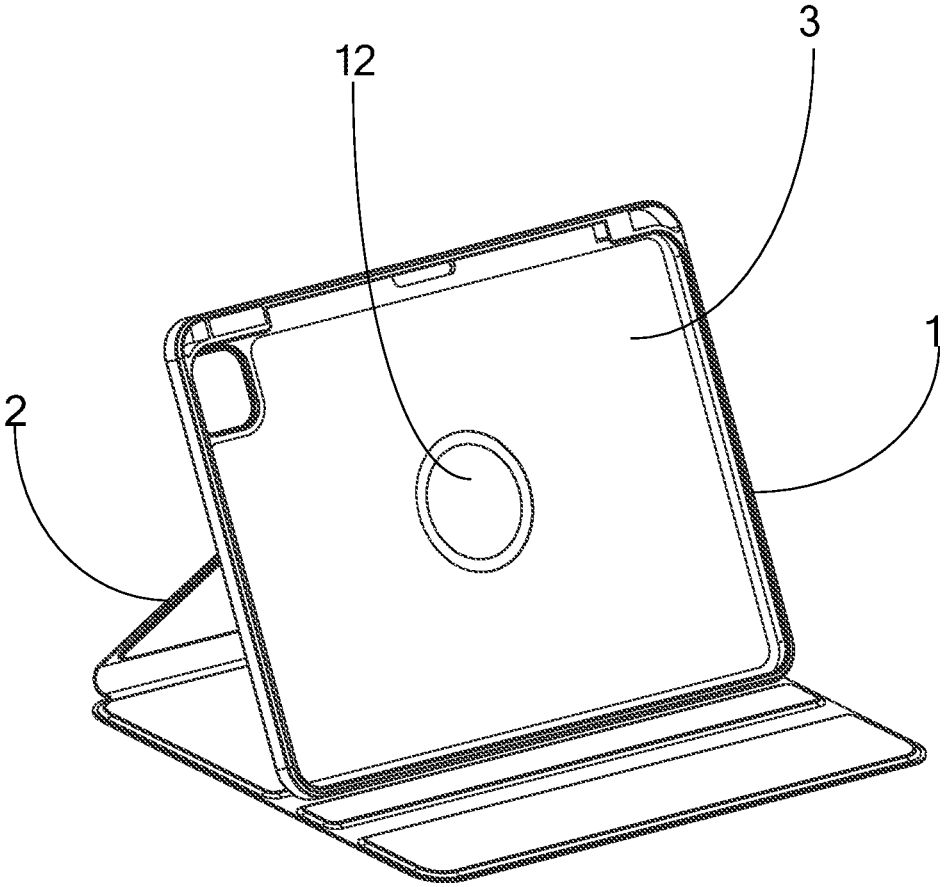
FIG. 1 is a schematic structural diagram of an embodiment of the present application.
Figure 2:
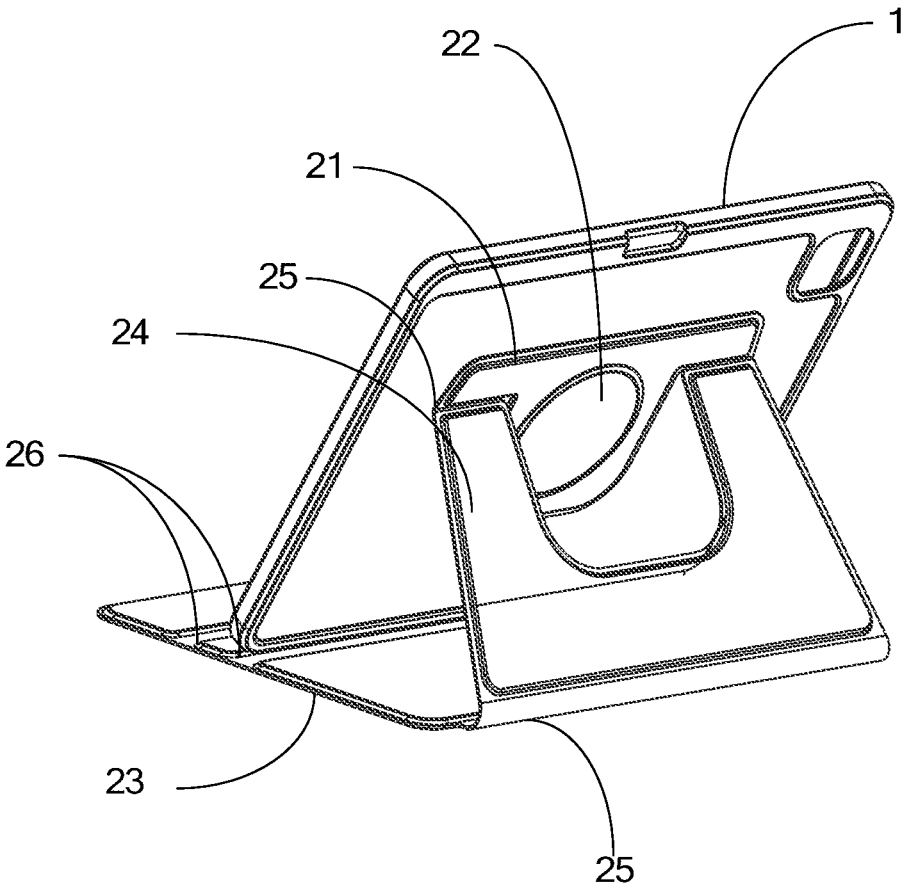
FIG. 2 is a schematic structural diagram of the back of the embodiment of the present application.
Figure 3:
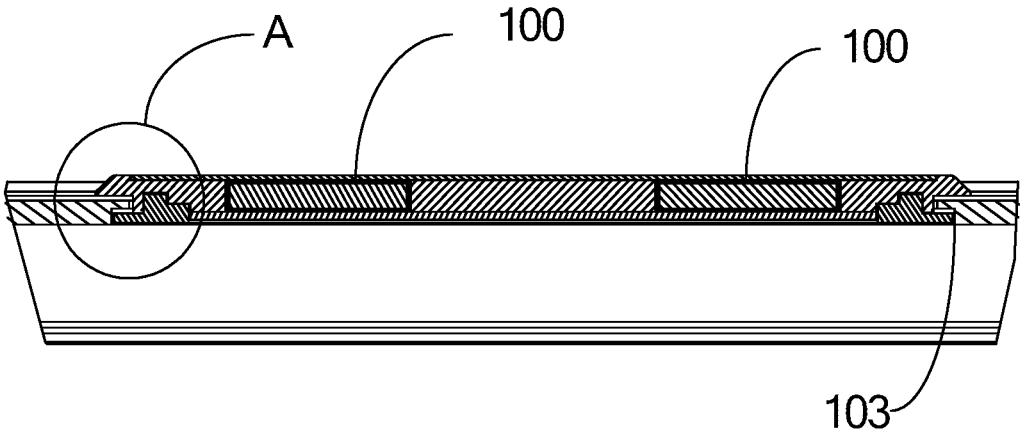
FIG. 3 is a schematic structural diagram of a first and second assembly components during rotational installation in the embodiment of the present application.
Figure 4:
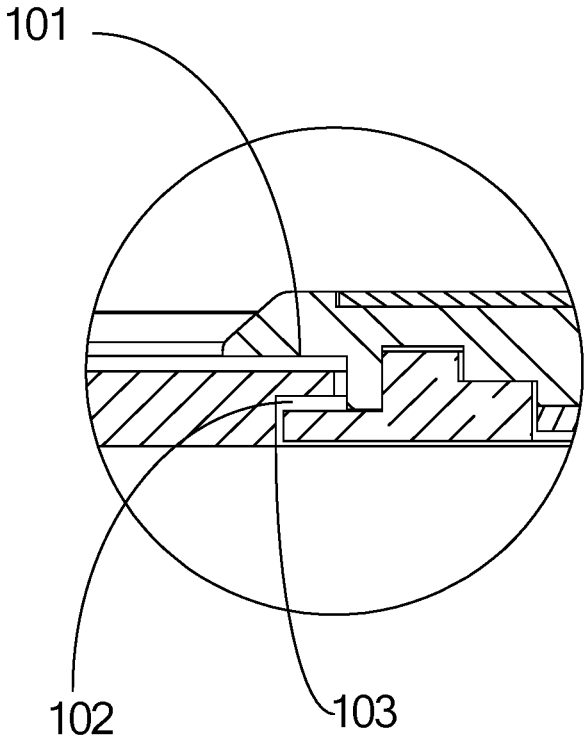
FIG. 4 is an enlarged schematic view of the embodiment of the present application at A in FIG. 3.
Figure 5:
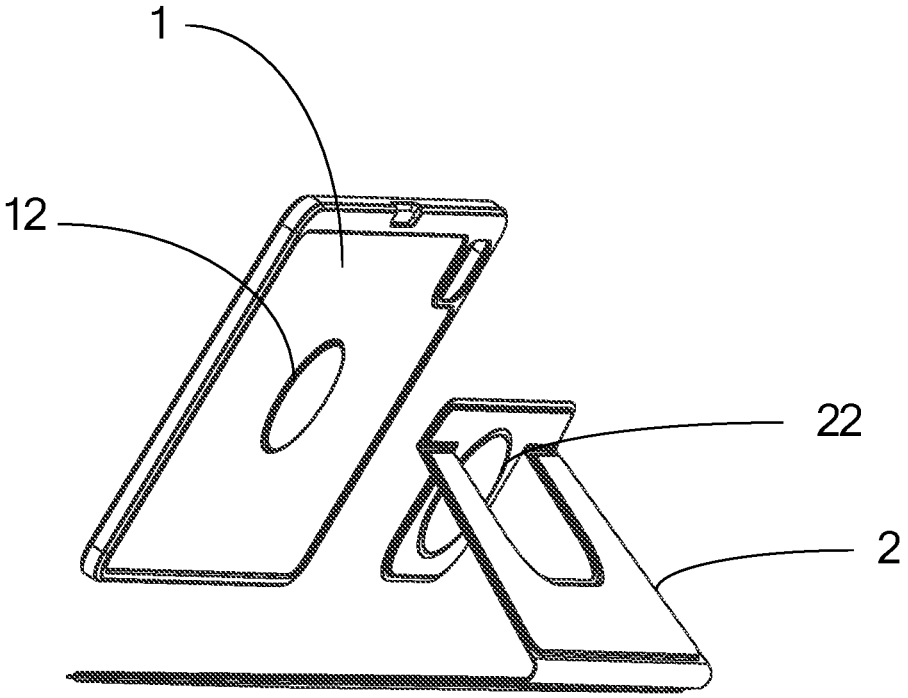
FIG. 5 is a split schematic diagram of the embodiment of the present application.
Figure 6:
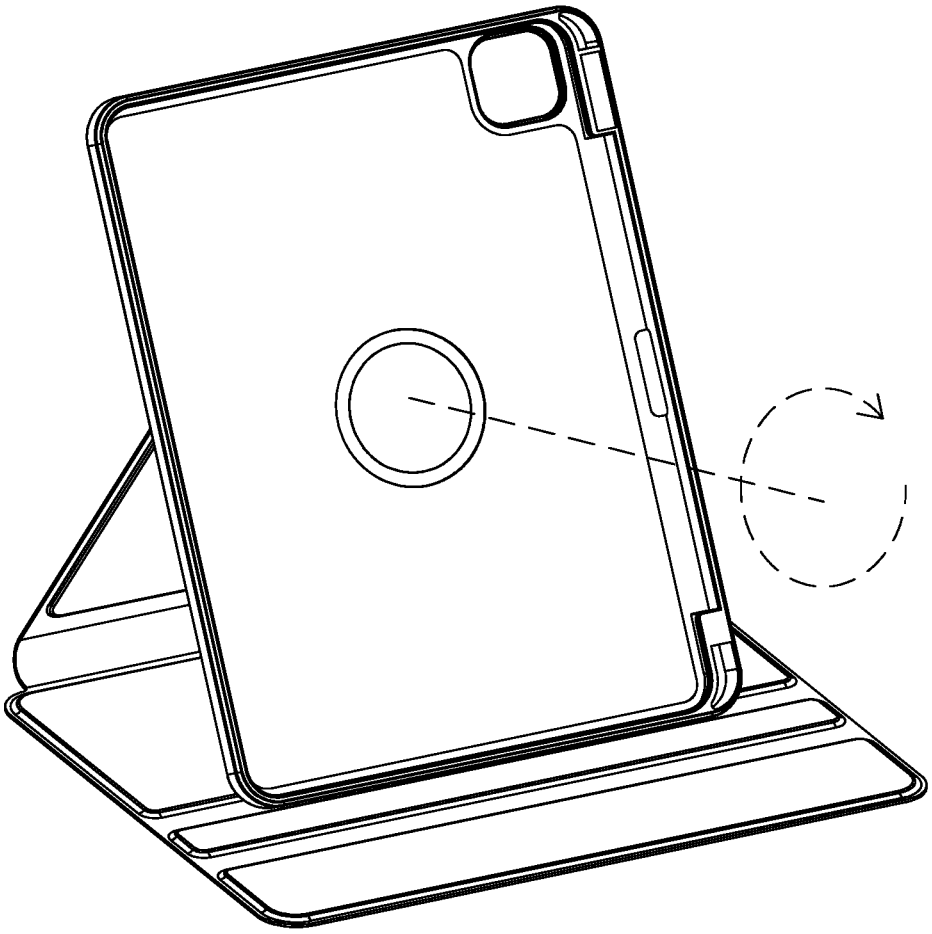
FIG. 6 is a structural schematic diagram of a vertical position after rotation in the embodiment of the present application.

As shown in FIG. 1 to FIG. 6, a tablet computer protective cover, including a cover body 1 and a support frame 2. The cover body 1 is provided with a cavity 11 for installing the tablet computer, the support frame 2 is provided with a bearing plate 21 for bearing the cover body, a back of the cover body 1 is provided with a first assembly component 12, a second assembly component 22 matched with the first assembly component 12 is arranged on the bearing plate 21; meanwhile, the cover body 1 and the support frame 2 of this embodiment need to rotate without being detached to meet the requirements of horizontal and vertical placement of the tablet computer.

Therefore, in this embodiment, the first assembly component 12 and the second assembly component 22 may rotate relative to each other after being combined, and for the design of specific structures, the following three structural settings can be adopted:

- the first type, the first assembly component 12 may be rotatably mounted on the back of the cover body 1, the second assembly component 22 is fixedly mounted on the bearing plate 21;
- the second type, the first assembly component 12 is fixedly mounted on the back of the cover body 1, and the second assembly component 22 is rotatably mounted on the bearing plate 21;
- the third type, the first assembly component 12 is rotatably mounted on the back of the cover body 1, the second assembly component 22 is rotatably mounted on the bearing plate 21.

When in use, the tablet computer is pre-mounted in the cavity of cover body 1, and then paired with the first assembly component 12 on the back of cover body 1 and the second assembly component 22 on the bearing plate 21, after the installation is completed, the tablet computer can be used normally. When the cover body needs to be adjusted horizontally or vertically, it is only necessary to keep the cover body 1 suspended. Then, the cover body 1 can be manually pushed to rotate at an angle, so that the cover body 1 may be placed horizontally and vertically, in the whole operation, the cover body 1 does not need to be detached, and the operation is very convenient.

Furthermore, for the alignment structure between the first assembly component 12 and the second assembly component 22, various forms can be used, such as buckles or threads, with the most preferred being magnetic attraction, Therefore, the first assembly component 12 and the second assembly component 22 of this embodiment are both embedded with a magnetic attraction member 100; the magnetic attraction member 100 of the first assembly component 12 is a magnet, and the magnetic attraction member 100 of the second assembly component 22 is an iron sheet. Alternatively, the magnetic attraction member 100 of the first assembly component 12 is an iron sheet, and the magnetic attraction member 100 of the second assembly component 22 is a magnet; alternatively, the magnetic attraction members 100 of the first assembly component 12 and the second assembly component 22 are magnets. In this way, for the first assembly component 12 and the second assembly component 22, the assembly and disassembly may be quickly and conveniently completed by relying on magnetic attraction, so that the cover body 1 may be used as a single body without being limited by the support frame 2.

Further, when the first assembly component 12 and second assembly component 22 are mounted in a rotating manner, the side surfaces of the first assembly component 12 and the second assembly component 22 are provided with annular clamping grooves 101, mounting holes 103 are defined on the opposite cover body 1 and the bearing plate 21, the first assembly component 12 and the second assembly component 22 are mounted in alignment in the mounting hole 103, and the annular clamping groove 101 is docked with a side opening of the mounting hole 103. In addition, a movable gap 102 is reserved between the annular clamping groove 101 and the side opening of the mounting hole 103, so that the first assembly component 12 and the second assembly component 22 may rotate.

When the first assembly component and the second assembly component are not selected for rotary installation, they can be directly connected to the corresponding support frame 2 or cover body 1 as a whole.

Furthermore, for the specific structure of support frame 2, the support frame 2 of this embodiment is further provided with a bottom plate 23 and a connecting plate 24, one end of the connecting plate 24 is connected with the bottom plate 23 through a bending part 25, and the other end of the connecting plate 24 is connected with the bearing plate 21 through the bending part 25.

In this way, a triangular support structure may be formed by relying on the bearing plate 21, the bottom plate 23, and the connecting plate 24, so that one end of the cover body 1 is placed on the bottom plate 23 to achieve support.

Furthermore, in order to prevent slipping when the cover body 1 is placed, at least one limiting groove 26 is defined on the bottom plate 23 of this embodiment, a groove width of the limiting groove 26 is greater than or equal to an outer edge width of the cover body 1. When multiple limiting grooves 26 are provided, the cover body 1 may be placed in different limiting grooves 26 to achieve different support angles.

The above is only the preferred embodiment of the present application, which does not limit the patent scope of the present application. Any equivalent structure or equivalent process transformation made by using the description and attached drawings of the present application, or directly or indirectly used in other related technical fields, are equally included in the patent protection scope of the present application.

What is claimed is:

1. A tablet computer protective cover, comprising a cover body and a support frame, wherein the cover body is provided with a cavity for installing the tablet computer, the support frame is provided with a bearing plate for bearing the cover body, a back of the cover body is provided with a first assembly component, a second assembly component matched with the first assembly component is arranged on the bearing plate;

wherein the first assembly component may be rotatably mounted on the back of the cover body relative to the cover body, and the second assembly component is fixedly mounted on the bearing plate;

or, the first assembly component is fixedly mounted on the back of the cover body, and the second assembly component is rotatably mounted on the bearing plate;

or, the first assembly component may be rotatably mounted on the back of the cover body, and the second assembly component may be rotatably mounted on the bearing plate;

wherein when the first and second assembly components are mounted in a rotating manner, the side surfaces of the first and second assembly components are provided with annular clamping grooves, mounting holes are defined on the opposite cover body and the bearing plate, the first and second assembly components are mounted in alignment in the mounting hole, and the annular clamping groove is docked with a side opening of the mounting hole; in addition, a movable gap is reserved between the annular clamping groove and the side opening of the mounting hole, so that the first assembly component and the second assembly component may rotate.

2. The tablet computer protective cover according to claim 1, wherein both the first assembly component and the second assembly component are embedded with magnetic attraction members;

a magnetic attraction part of the first assembly component is a magnet, and a magnetic attraction part of the second assembly component is an iron sheet;

or, the magnetic attraction part of the first assembly component is an iron sheet, and the magnetic attraction part of the second assembly component is a magnet;

or, the magnetic attraction parts of the first assembly component and the second assembly component are both magnets.

3. The tablet computer protective cover according to claim 1, wherein the support frame is further provided with a bottom plate and a connecting plate, one end of the connecting plate is connected with the bottom plate through a bending part, and the other end of the connecting plate is connected with the bearing plate through the bending part.

4. The tablet computer protective cover according to claim 3, wherein at least one limiting groove is defined on the bottom plate.

* * * * *